United States Patent [19]

Smrt

[11] 3,977,570

[45] Aug. 31, 1976

[54] SPRAYING APPARATUS

[76] Inventor: Thomas J. Smrt, 31W 300 W. Bartlett Road, Bartlett, Ill. 60103

[22] Filed: June 20, 1975

[21] Appl. No.: 588,813

[52] U.S. Cl. ..... 222/174; 239/532; 403/107

[51] Int. Cl.[2] ..... B67D 5/64

[58] Field of Search ..... 222/173, 174, 162, 179, 222/191; 294/19; 239/281, 282, 532; 248/411, 125, 124, 298, 295, 286, 287; 403/107, 105

[56] References Cited

UNITED STATES PATENTS

| | | | |
|---|---|---|---|
| 1,006,078 | 10/1911 | Fulford | 222/523 |
| 2,438,633 | 3/1948 | Condor | 403/107 |
| 2,720,422 | 10/1955 | Mercur | 222/174 |
| 3,510,028 | 5/1970 | Batistelli | 222/174 |
| 3,726,440 | 4/1973 | Deeb | 222/174 |
| 3,806,000 | 4/1974 | Fegley | 222/180 |
| 3,856,209 | 12/1974 | Hickson | 222/174 |

*Primary Examiner*—Robert B. Reeves
*Assistant Examiner*—H. Grant Skaggs

[57] ABSTRACT

An apparatus for spraying the contents of aerosol spray cans includes a pair of telescopingly related housings so that the length of the apparatus can be varied as desired. The aerosol can is mounted on one end of one of the housings, and a handle is provided on the opposite end of the other housing. The valve of the aerosol can is operated by a pair of actuator rods which are telescopingly engaged within the housings, and a latch releasably locks the actuator rods in the desired position.

3 Claims, 7 Drawing Figures

SPRAYING APPARATUS

BACKGROUND AND SUMMARY

This invention is an improvement over the spraying device described in my prior U.S. Pat. No. 3,485,206. The device described in the patent includes an elongated one-piece body or housing on which the aerosol spray can is mounted, and an elongated one-piece trigger or actuator rod. The length of the apparatus is therefore fixed.

It is often desirable to change the length of such a spraying device. For example, such a spraying device is advantageously used to mark athletic fields, parking lots, and the like by spraying a marking paint on the ground or pavement. The device is operated most comfortably if the operator can stand erect when the valve of the aerosol spray can is spaced slightly from the surface to be marked. The length of a spraying apparatus formed in accordance with the invention can be adjusted to the length that is most comfortable for each operator. Further, when the spraying apparatus is stored or carried, the length of the apparatus can be reduced to a fraction of its maximum length. The adjustability of the spraying apparatus is provided by a pair of telescoping housings and a pair of telescoping actuator rods. The housings and actuator rods are maintained in a desired position by a latch which releasably locks the actuator rods against telescoping movement.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
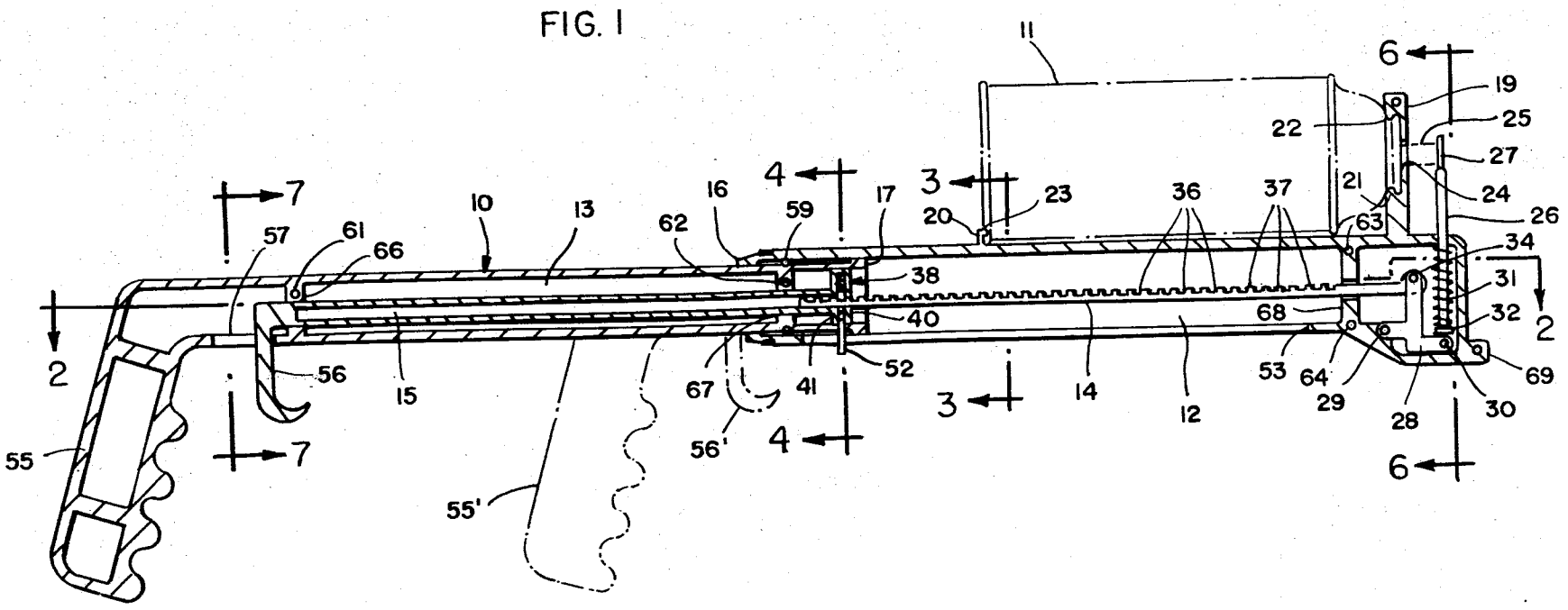
FIG. 1 is a longitudinal sectional view of a spraying apparatus formed in accordance with the invention.
Figure 2:
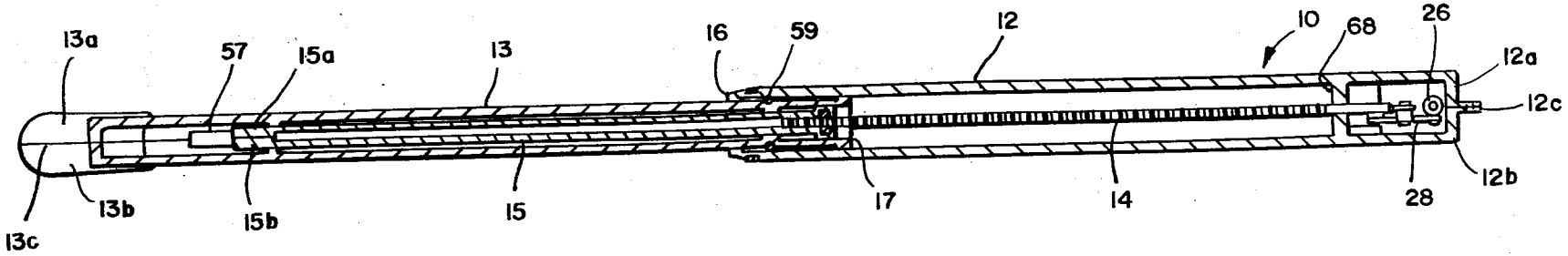
FIG. 2 is a sectional view taken along the line 2—2 of FIG. 1.

Referring now to FIGS. 1 and 2, the numeral 10 designates generally a spraying apparatus which is adapted to spray the contents of an aerosol spray can, designated in phantom at 11. The spraying apparatus includes a pair of elongated tubular housings 12 and 13 and a pair of elongated actuator rods 14 and 15 which extend coaxially within the housings.

In the embodiment illustrated the outer or larger housing is the front housing 12 which telescopingly receives the smaller housing 13. Both of the housings are generally rectangular in transverse cross section (FIG. 4), and the rear end of the housing 12 includes a transverse end flange 16 which provides a rectangular opening sized to snugly receive the inner or rear housing 13. The outer surface of the inner housing 13 is spaced inwardly from the inner surface of the housing 12, and the forward end of the housing 13 is provided with an outwardly extending perimetric flange 17 which slidably engages the inner surface of the housing 12. The relatively snug sliding engagement between the flange 16 and the outer surface of the housing 13 and the flange 17 and the inner surface of the housing 12 maintains the two housings substantially parallel and substantially prevents wobbling of the housings as they telescope.

An aerosol can whose contents are to be sprayed can be mounted on the front housing by longitudinally spaced can-retaining brackets 19 and 20. The bracket 19 extends generally transversely outwardly from the forward end of the front housing and is provided with a generally cylindrical recess 21 which is sized to receive the conventional cup-shaped closure member on aerosol cans. Such cup-shaped closures include a beaded rim, and the retaining bracket 19 includes a projection 22 which extends inwardly into the recess 21 to engage the beaded rim. After the beaded rim is positioned under the projection 22, the can can be forced against the outer surface of the housing 12. The bracket 20 is generally L-shaped and is formed of flexible and resilient material. The outer end of the bracket 20 is initially forced to the left as viewed in FIG. 1 by the beaded bottom rim of the can until the rim passes the forwardly projecting outer end 23 of the bracket, and the bracket will then return to its original position. The bottom rim of the can will be retained against the outer surface of the housing 12 by the projection 23 of the bracket 20.

Figure 6:
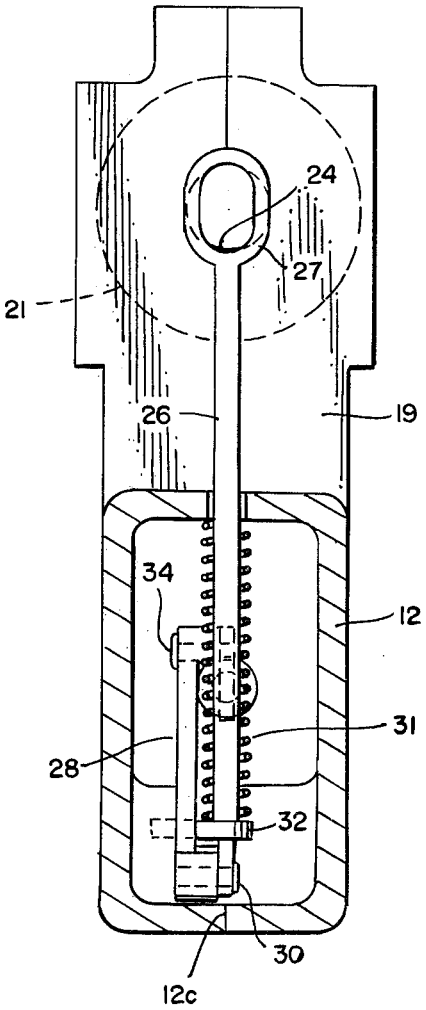
FIG. 6 is a sectional view taken along the line 6—6 of FIG. 1.
Figure 7:
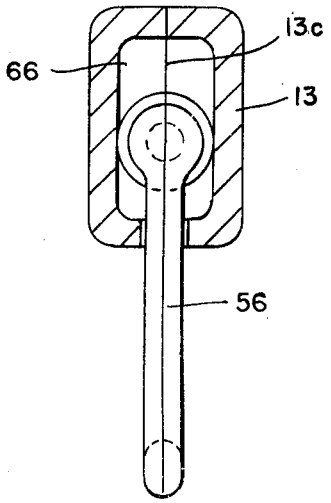
FIG. 7 is a sectional view taken along the line 7—7 of FIG. 1.

The mounting brackets 19 and 20 position the aerosol can so that the longitudinal axis thereof is parallel to the longitudinal axes of the housings 12 and 13. The bracket 19 is provided with a central opening 24 through which a valve-actuator 25 of the aerosol can extends. The spraying device is intended for use with aerosol cans which are equipped with valves of the type which are opened when the actuator is tilted or moved transversely with respect to the axis of the can. For this purpose the spraying device includes a rod 26 which extends transversely through an opening at the front end of the housing 12 and terminates in a ring-shaped or push rod T-shaped end 27 (see also FIG. 6) which is sized to receive the actuator of the aerosol can.

The rod 26 can be moved transversely outwardly by a bell crank 28 which is pivotally mounted within the housing 12 by a pin 29. The rod 26 is pivotally connected to one of the legs of the bell crank by a pin 30, and the rod is resiliently biased against outward movement by a coil spring 31 which is positioned between a stop 32 on the rod 26 and the wall of the housing. The other leg of the bell crank is pivotally connected by a pin 34 to the front end of the actuator rod 14.

The actuator rod 14 is provided with a plurality of longitudinally spaced notches or recesses 36 which define a plurality of longitudinally spaced detents or teeth 37. The outer periphery of the actuator rod 14 is circular in cross section (FIG. 5), and the actuator rod 14 is telescopingly received by the tubular actuator rod 15, which is cylindrical in cross section. The position of the actuator rod 14 within the actuator rod 15 is releasably fixed by a latch assembly 38.

Figure 3:
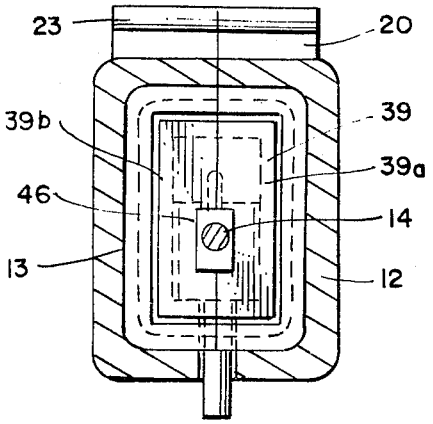
FIG. 3 is a sectional view taken along the line 3—3 of FIG. 1.
Figure 4:
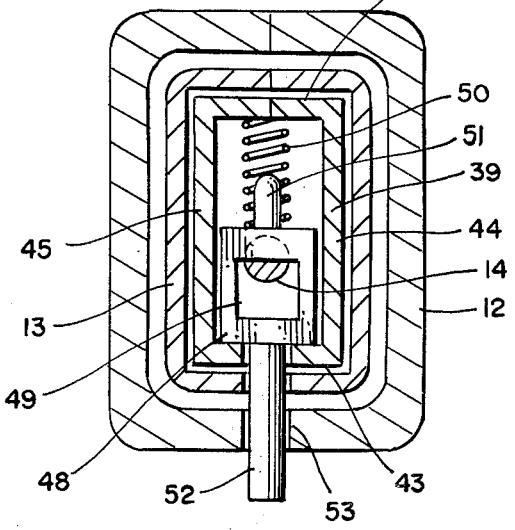
FIG. 4 is a sectional view, on a larger scale than FIG. 3, taken along the line 4—4 of FIG. 1.

Referring to FIGS. 3 and 4, the latch assembly includes a generally box-like latch housing 39 which is carried by the forward end of the outer actuator rod 15. The latch housing includes front and rear walls 40 and 41 (FIG. 1), top and bottom walls 42 and 43 (FIG. 4), and side walls 44 and 45. The front wall 40 is provided with a rectangular opening 46 (FIG. 3) through which the actuator rod 14 extends, and the rear wall 41 is connected directly to the tubular wall of the actuator rod 15. For ease of illustration, the scale of FIG. 4 is enlarged from that of FIG. 3.

A generally rectangular latch 48 is positioned within the enclosure formed by the walls of the latch housing and is provided with a central rectangular opening 49 through which the actuator rod 14 extends. The latch 48 is sized so that it is received relatively snugly within the chamber of the latch housing but may slide freely in a vertical direction as viewed in FIGS. 4 and 5, which is a direction transverse to the axis of the actuator rods and the housings. The latch is resiliently biased downwardly against the bottom wall 43 of the latch housing by a coil spring 50, which is ensleeved over a positioning pin 51 on the top of the latch. The latch can be pushed upwardly against the bias of the spring by a pin or release button 52 which extends downwardly from the latch through openings in the bottom wall 43 of the latch housing and the bottom wall of the housing 13 and through an elongated longitudinally extending slot 53 in the housing 12.

Figure 5:
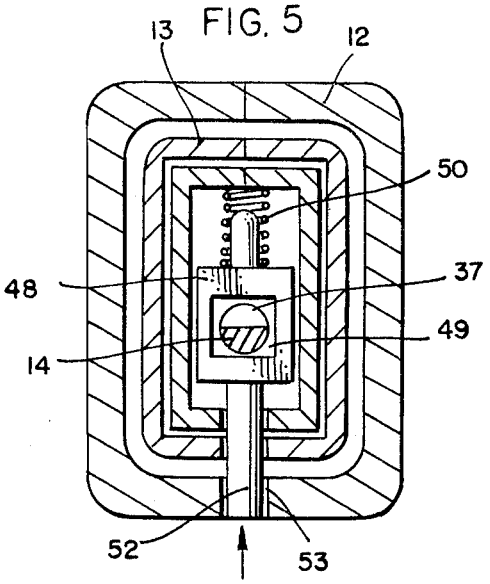
FIG. 5 is a view similar to FIG. 4 showing the latch in the released position.

The thickness of the latch, i.e., the dimension which extends parallel to the longitudinal axis of the actuator rods, is slightly less than the spacing between adjacent teeth 37 on the actuator rod 14, and the latch is illustrated in its latching position in FIG. 4 in which the latch is maintained in one of the recesses 36 of the actuator rod 14 by the spring 50. In this position the latch connects the actuator rods 14 and 15 for common longitudinal movement, and movement of one of the actuator rods will cause movement of the other actuator rod. FIG. 5 illustrates the latch in the unlatched or released position in which the latch has been moved upwardly against the bias of the spring 50 by pushing upwardly on the release button 52 until the actuator rod 14 is centered within the opening 49 of the latch. In this position, the actuator rods are free to telescope relative to each other.

Referring again to FIG. 1, the left or rear end of the rear housing 13 is provided with a handle or grip 55 which extends generally transversely to the longitudinal axis of the housings and which permits the operator to hold the spraying device in one hand. The rear end of the actuator rod 15 terminates in a transversely extending trigger or finger portion 56 which extends outwardly through a slot 57 in the housing 13 adjacent the handle. The operator can thus grip the handle with the thumb and three fingers of one hand and pull the trigger 56 rearwardly with his index finger. When the latch is in the latching position, rearward movement of the actuator rod 15 will cause rearward movement of the actuator rod 14, and the bell crank 28 will be rotated counterclockwise to force the rod 26 transversely outwardly, or upwardly as viewed in FIG. 1. This transverse movement of the rod 26 will move the valve actuator 25 of the can to open the valve. Although the inner and outer housings 12 and 13 are telescopingly related, relative movement of the housings when the trigger 56 is pulled is prevented by an O-ring 59 which is positioned in an annular groove near the forward end of the inner housing 13. The O-ring is formed of a compressible, resilient material which engages the inner surface of the housing 12 to provide sufficient frictional force to prevent telescoping movement of the housings when the trigger is pulled and give more firmness and solidity to unit.

When the length of the spraying apparatus is to be adjusted, the release button 52 is pushed inwardly until the end thereof is flush with the outer surface of the housing 12 as shown in FIG. 5. In this position the actuator rod 14 will be centered within the rectangular opening 49 of the latch, and the actuator rods will be free to telescope. The release button can be maintained in this position by the hand which grasps the housing 12, and the other hand can grasp the housing 13. The inner housing 13 can thereby be pushed or pulled out of the outer housing 12 against the frictional force exerted by the O-ring 59 until the overall length of the spraying device is adjusted as desired. Telescoping movement of the housings 12 and 13 will also cause telescoping movement of the actuator rods 14 and 15. When the length of the spraying device is adjusted, the release button 52 is released, and the latch will be forced by the spring 50 into one of the recesses 36 of the actuator rod 14 to lock the actuator rods against further telescoping movement. The O-ring 59 provides a stop against excessive withdrawal of the housing 13 from the housing 12 and ensures that the actuator rod 14 will not be withdrawn completely from the actuator rod 15. When telescoping together, operator must push trigger 56 away from handle 55 as far as it will go in the opening 57 before releasing button 52.

Each of the housings 12 and 13 are advantageously formed from a pair of identical molded plastic halves which are joined along the longitudinal center lines. Referring to FIG. 2, the housing 13 is formed of housing halves **13*a* and 13*b* which are joined along the center line 13*c* by pins 61 and 62 (FIG. 1). Similarly, housing 12 is formed of housing halves 12*a* and 12*b* which are joined along the center line 12*c* by pins 63 and 64 (FIG. 1). The housing halves 13*a* and 13*b* are molded with transversely extending walls 66 and 67 which not only strengthen the housing 13 but provide support for the actuator rod 15. Similarly, the housing halves 12*a* and 12*b* are molded with transversely extending walls 68 which strengthen the housing and provide support for the actuator rod 14**.

In the particular embodiment illustrated, the front of the housing 12 is also provided with a support bracket 69 for attachment to a compass when the spraying device is used to mark circles.

The actuator rod 15 and the latch housing 39 can also be molded from a pair of mold halves **15*a* and 15*b* (FIG. 2) and 39*a* and 39*b* (FIG. 3). Each of the halves of the latch housing can be molded integrally with the corresponding half of the actuator rod, and the halves can be suitably joined along the center line by adhesive or the like after the latch 49 and spring 51** are positioned within the latch housing.

The spraying device is advantageously used to mark pavement, athletic fields, gardens, and the like, and the operator can hold the spraying device in one hand by grasping the handle 55. The length of the spraying device is adjusted so that the operator can position the actuator of the aerosol can adjacent the surface to be marked while maintaining a comfortable, erect position. The spraying device is held generally vertically so that the can points to the surface to be marked, and the contents of the can can be sprayed while the operator walks over the surface. When spraying is to be discontinued, the operator merely releases the trigger 56, and the spring 31 at the front of the spraying device will cause the rod 26, the bell crank 28, and the actuator rods 14 and 15 to return to their original positions. If the can is to be sprayed when pointed downwardly, it is not provided with a dip tube.

When the spraying device is carried or is stored or used in a cramped location, the inner housing 13 can be substantially completely retracted within the outer housing 12 so that the handle and trigger assume the positions illustrated in phantom in FIG. 1 at 55' and 56'. In this position, the overall length of the spraying device is about 60% of the length of the spraying device when the housings are fully extended.

While in the foregoing specification a detailed description of a specific embodiment of the invention was set forth for the purpose of illustration, it is to be understood that many of the details hereingiven may be varied considerably by those skilled in the art without departing from the spirit and scope of the invention.

I claim:

1. A spraying apparatus for spraying the contents of a valve-equipped aerosol spray can comprising elongated front and rear housings, one of the housings being telescopingly received by the other housing and the rear housing having a hand grip thereon, mounting means on the front housing for holding an aerosol spray can, a front actuator rod mounted within the front housing for longitudinal sliding movement therein, a rear actuator rod mounted within the rear housing for longitudinal sliding movement therein, the front and rear actuator rods being telescopingly related and the rear actuator rod having a finger grip thereon adjacent the hand grip of the rear housing, valve-actuating means on the front housing connected to the front actuator rod for opening the valve of the aerosol can when the front actuator rod moves longitudinally, a latch housing on one of the actuator rods and a latch positioned within the latch housing for movement in a direction transverse to the direction of said longitudinal movement, spring means for resiliently biasing the latch into a latching position, and an actuating button for the latch extending from the latch housing through a slot in one of the housings for moving the latch out of the latching position, the other actuator rod including a plurality of longitudinally spaced detents engageable with the latch when the latch is in the latching position whereby longitudinal movement of one of the actuator rods causes longitudinal movement of the other actuator rod, the actuator rods and the front and rear housings being telescopable when the latch is not in its latching position whereby the length of the spraying apparatus can be varied, and friction means positioned between the housings for frictionally preventing telescoping movement of the housings when the latch is in the latching position and the actuator rods are moved to open the valve but permitting telescoping movement of the housings when the latch is released.

2. The apparatus of claim 1 in which the friction means is an O-ring.

3. A spraying apparatus for spraying the contents of a valve-equipped aerosol spray can comprising an elongated tubular front housing, mounting means on the front housing for holding an aerosol spray can, an elongated tubular rear housing telescopingly received by the front housing, the rear housing having a handle at the rear end thereof, each of the front and rear housings being formed from a pair of molded plastic halves which are connected together along the longitudinal center line of the housings, an elongated front actuator rod mounted within the front housing for longitudinal sliding movement therein, crank means mounted on the front housing and connected to the front actuator rod for opening the valve when the first actuator rod is moved longitudinally, an elongated tubular rear actuator rod mounted within the rear housing for longitudinal sliding movement therein, the front actuator rod being telescopingly received by the rear actuator rod, the rear end of the rear actuator rod terminating adjacent the handle of the rear housing, the front actuator rod including a plurality of longitudinally spaced detents, a latch housing mounted on the forward end of the rear actuator rod, a latch positioned within the latch housing for movement in a direction transverse to the direction of said longitudinal sliding movement, the latch being movable within the latch housing between a latching position in which the latch is engageable with said detents on the front actuator rod and the front and rear actuator rods are secured against telescoping movement and a released position in which the latch is not engageable with said detents and the actuator rods and the front and rear housings are telescopeable to vary the length of the spraying apparatus, and friction means positioned between the housings for frictionally preventing telescoping movement of the housings when the latch is in the latching position and the actuator rods are moved to open the valve but permitting telescoping movement of the housings when the latch is released.

* * * * *